US005319870A

United States Patent [19]

Weiss

[11] Patent Number: 5,319,870

[45] Date of Patent: Jun. 14, 1994

[54] MOUNTED SUPPORT FOR A BANNER

[76] Inventor: Harvey I. Weiss, 911 Mt. Vernon, Lake Forest, Ill. 60045

[21] Appl. No.: 851,310

[22] Filed: Apr. 20, 1992

[51] Int. Cl.[5] ..... G09F 17/00

[52] U.S. Cl. ..... 40/606; 40/610; 160/329

[58] Field of Search ..... 40/603, 604, 606, 602, 40/610; 160/329, 351

[56] References Cited

U.S. PATENT DOCUMENTS

| | | | |
|---|---|---|---|
| 170,040 | 11/1875 | Young | 160/329 |
| 1,346,664 | 7/1920 | McMahon | 160/329 |
| 1,480,501 | 1/1924 | Bryant | 160/329 |
| 2,236,986 | 4/1941 | Beeman et al. | 160/329 |
| 2,470,318 | 5/1949 | Nadelson | 160/329 |

*Primary Examiner*—James R. Brittain
*Assistant Examiner*—C. Hope Davis
*Attorney, Agent, or Firm*—Irwin C. Alter

[57] ABSTRACT

An adjustable support for banners comprises at least a pair of stanchions for connection to a banner. The stanchions each define an array of transverse slots distributed along the length of each stanchion. At least a pair of spaced brackets are attached to a support structure, each of the brackets defining a longitudinal aperture slidably receiving one of the stanchions in one of variable longitudinal positions. The brackets each also define transverse slot capable of registry with at least one transverse slot of the stanchion received in the longitudinal aperture. First removable cross bar extend through the transverse slot of each bracket and the transverse slot or slots of the stanchion received in each bracket. Extension spring may be provided to connect a banner to each stanchion to assist in wind resistance of the banner.

18 Claims, 5 Drawing Sheets

MOUNTED SUPPORT FOR A BANNER

BACKGROUND OF THE INVENTION

Large banners represent an effective means for advertising of an event, a service, or a product. The banner is of course relatively inexpensive per square foot of area and can be made quite large for good visibility. Also, the banner may be replaced with another banner having a different message or style of presentation, being comparable if desired to the size of a large advertising sign, but much less expensive.

If a user of banners for advertising has a place for display of the banner such as the roof of a building, the user may desire to display at different times banners of different size and area, depending upon the particular message to be displayed.

In accordance with this invention, an inexpensive, versatile support for banners is provided, which support is adjustable so that it can display banners of differing sizes or at differing elevations. Also, the banner display of this invention provides a measure of wind resistance, to the banner as may be desired to permit the banner to deflect from its mounting to spill wind, to reduce the possibility of tearing of the banner or to overstress the stanchions that hold the banner.

DESCRIPTION OF THE INVENTION

By this invention an adjustable support for banners is provided which comprises at least a pair of stanchions for connection to a banner. The stanchions each define an array of transverse slots distributed along the length of each stanchions, at least a pair of spaced brackets are attached to a support structure, such as the roof of a building or any other desired place where the brackets might be mounted. Each of the brackets define a longitudinal aperture slidably receiving one of the stanchions in one of variable longitudinal positions, to permit longitudinal adjustment of the length of the stanchions to fit the size of the banner being carried, and for the desired amount of elevation of the banner.

The brackets also each define transverse slot means which are capable of registry with at least one transverse slot of the stanchion received in the longitudinal aperture. Preferably, a pair of slots of the brackets may register with a pair of transverse slots of the stanchion. First removable cross bar means are provided, extending through the transverse slot means of each bracket and also through the at least one transverse slot of the stanchion received in each bracket, for retention of the stanchion in the bracket at the desired sliding position.

It is also a feature of this invention that a support for banners is provided which comprises a pair of stanchions secured to spaced brackets, and in which extension spring means connect a banner to each stanchion. Thus, as a strong wind blows, the banner can deflect by stretching of the springs, to provide a resilient, wind-resistant system, which preferably can "spill" wind in the manner of a sail on a heeling boat to avoid wind overpressure.

It is also preferred for second, removable cross-bar means to extend through other of the transverse slots of each stanchion. The second cross bar means are connected to the spring means and serve to connect the spring means to each stanchion. All cross bar means may typically be temporarily retained in their position in the slots by means of cotter pins or the like.

Preferably, each stanchion defines at least three times as many of the transverse slots as there are slots of the transverse slot means in each bracket. Thus, if each bracket carries a pair of slots of the transverse slot means, each stanchion will preferably define at least six transverse slots, and most preferably a substantially higher number than that, so that the stanchions of this invention may be adjustably positioned at varying heights, and other slots of the stanchion may be used to secure the banner.

Thus, an adjustable support of banners is provided which is of simple construction, but is strong, and is of easily adjustable size, as will be particularly shown in the specific embodiments below.

DESCRIPTION OF SPECIFIC EMBODIMENT

Figure 1:
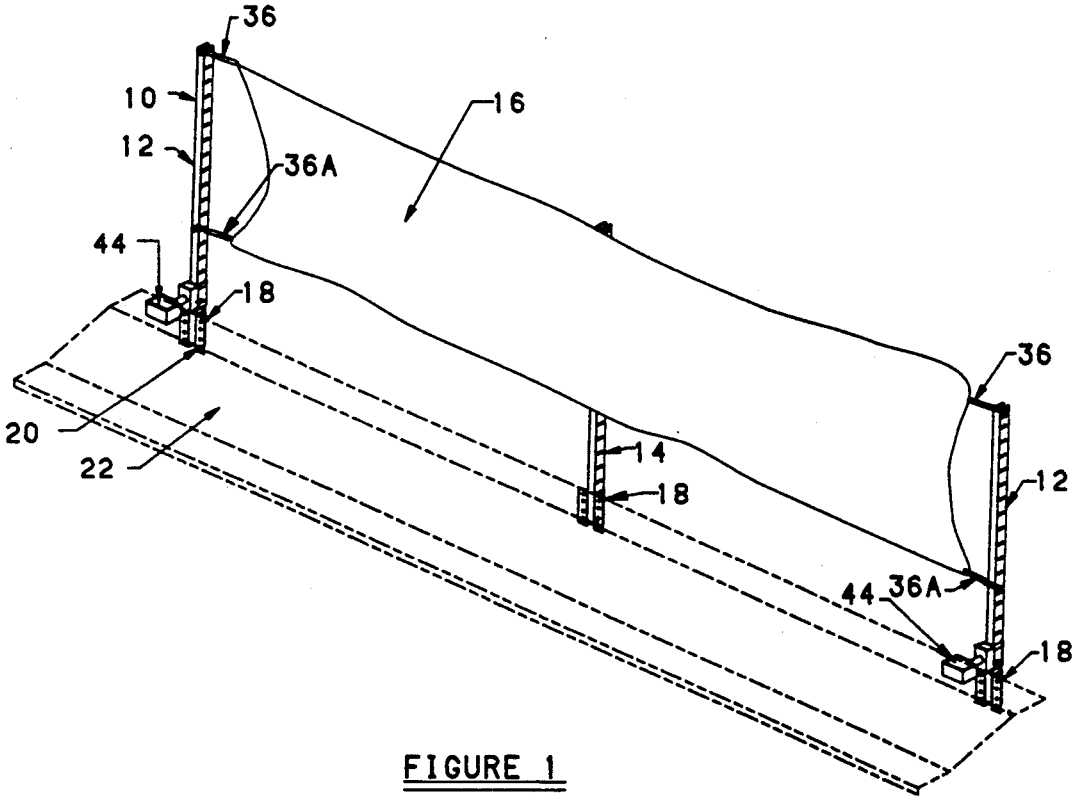
FIG. 1 is a perspective view of an adjustable support for banners in accordance with this invention, mounted on the side of a flat roof.
Figure 2:
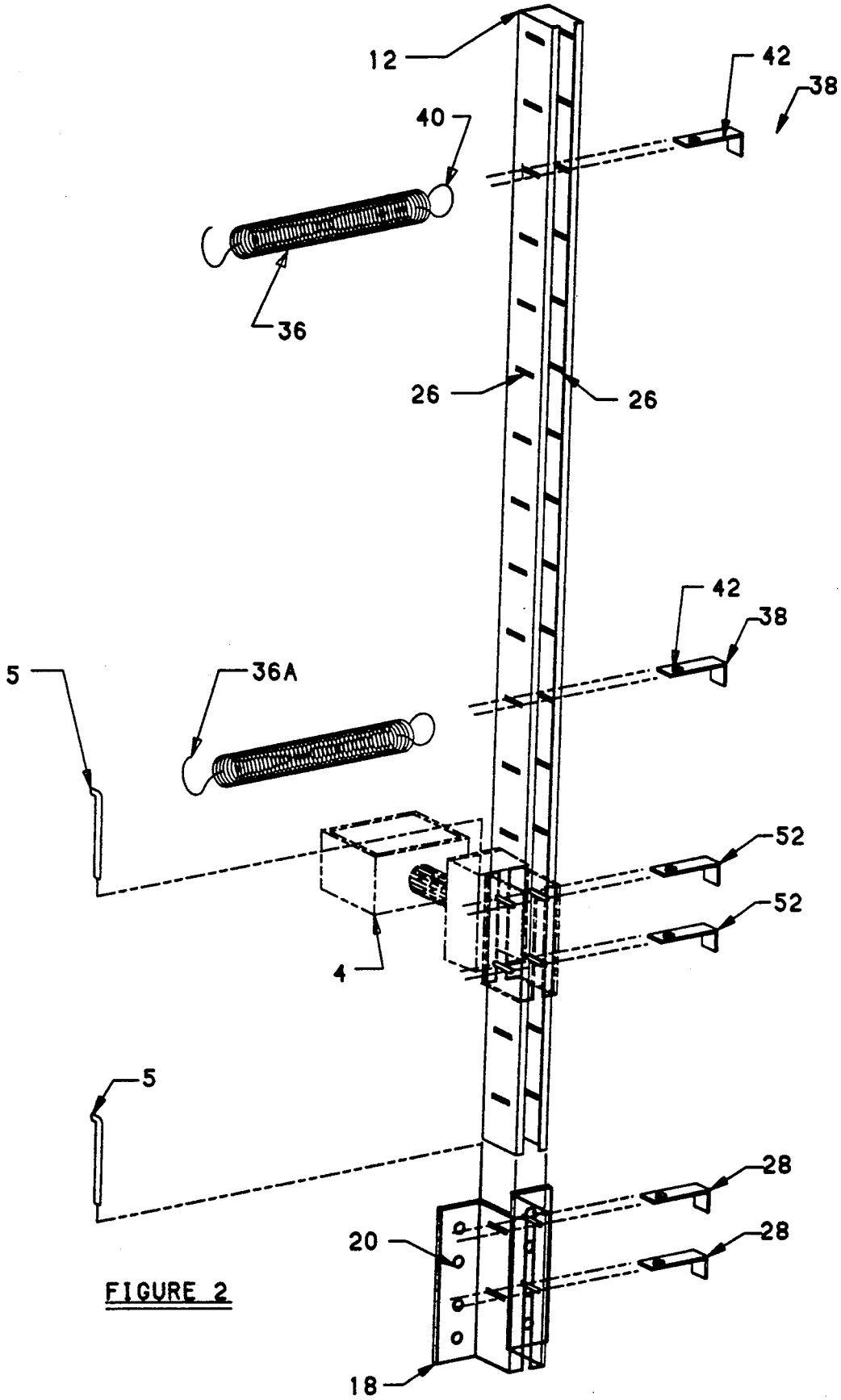
FIG. 2 is an enlarged, exploded perspective view of one stanchion and bracket of FIG. 1.

Referring to the drawings, the adjustable banner support 10 of this invention comprises a pair of vertical stanchions 12 plus a central support stanchion 14 for supporting a banner 16. Each of stanchions 12, 14 are slidably received in the vertical aperture 17 of a bracket 18, as particularly illustrated in FIG. 3. Bracket 18 is attached through bolt holes 20 or the like to a vertical surface of roof 22, or any other desired surface, by screws, bolts or the like. Bracket 18 is made of a shaped piece of metal, with pairs of slots 24 which are aligned with each other and positioned so that corresponding slots 26*a* of an array of slots 26 formed on stanchion 12 can be in registry with the respective slots 24.

Typically, the respective slots 26 of stanchion 12 are all equally spaced so that any pair of them can enter into registry with the respective pairs of slots 24 of the bracket, so that the stanchions 12 may be secured to brackets 18 by means of cross bars 28 which pass through respective slots 24, 26*a*.

Each cross bar 28 preferably defines an aperture at its forward end 30 through which a locking pin 32 may pass, to prevent accidental withdrawal of cross bars 28 from engagement with the respective slots 24, 26*a*. Thus, stanchion 12 is firmly, but removably and adjustably, retained in bracket 18.

Figure 3:
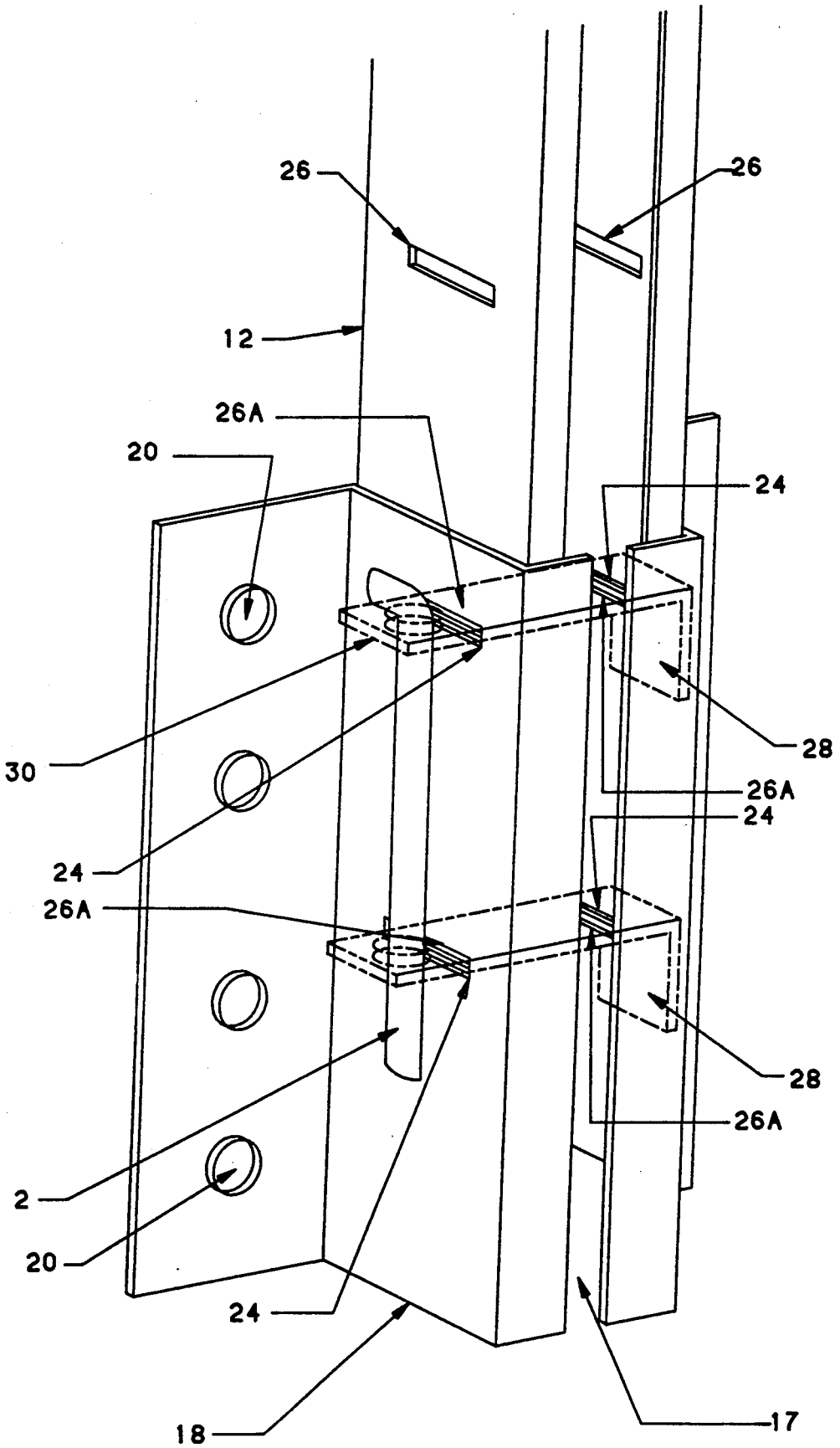
FIG. 3 is a further enlarged, fragmentary perspective view of one bracket of the stanchion of FIG. 1, showing details of the retention of the stanchion.

Stanchion 12 in FIG. 3 is shown in its highest vertical position. To lower the stanchion, one simply removes retention pin 32 and cross-bars 28, lowering the stanchion until other slots 26 come into engagement with slots 24. Then, cross bar 28 may be reinserted, and pin 32 reapplied to lock the system in place, with the stanchion occupying a new position of less upward extension. Thus, banners of variable sizes may be displayed.

Stanchion 14 is provided to assist in retaining the banner against wind resistance, and to reduce the amount of bowing that the banner may exhibit during a heavy wind that pushes banner 16 against stanchion 14.

Banner 16 is preferably secured to stanchions 12 by a connection that includes extension springs 36, 36*a* connected to each corner of banner 16 and secured to stanchion 12. Alternatively, to further facilitate the spilling of wind, one of the sets of extension springs 36, 36*a* may be replaced with a non-resilient connection to the stanchion, so that in a heavy wind the banner is blown away from the vertical by the resilience of the springs, either at the top edge or the bottom, to facilitate the "spilling" of wind out of the banner rather in the manner that a heeling sail boat spills wind under heavy wind conditions.

However, in the specific embodiment shown, all four corners of the banner are connected to respective springs 36, 36*a*. One end of each spring is attached conventionally to a corner of banner 16, while other ends of the springs 36, 36*a* are attached to another cross bar member 38, typically being similar in structure to cross bar members 28. The ends 40 of coil springs 36, 36*a* may be secured by tieing, welding or some other conventional manner to cross bars 38. The particular slots 26 through which cross bars 38 project may be selected to best display the banner.

The respective stanchions 12, 14 may also carry a light assembly 44 for illuminating the banner 16, or any other desired device, in a manner which is structurally similar to the other connections to stanchions 12. Light assembly 44 may be connected to a bracket 46, having a longitudinal aperture 48 that receives stanchion 12 in sliding relation. In a manner analogous to bracket 18, bracket 46 defines pairs of slots 50 which are spaced to register with the slot pairs 26 which are distributed along the length of stanchion 12.

Figure 4:
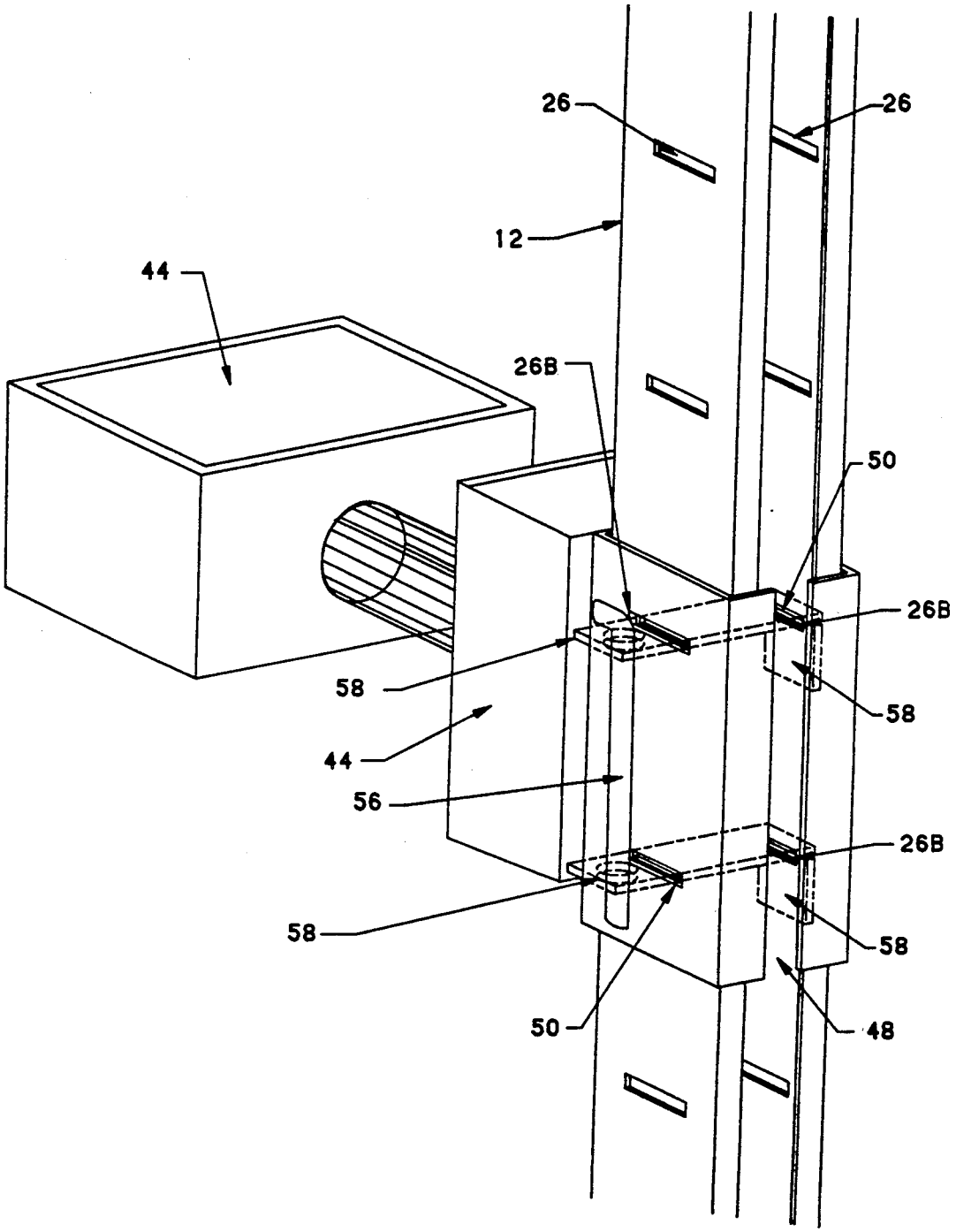
FIG. 4 is an enlarged, fragmentary perspective view showing how a light may be carried on one of the stanchions of FIG. 1.
Figure 5:
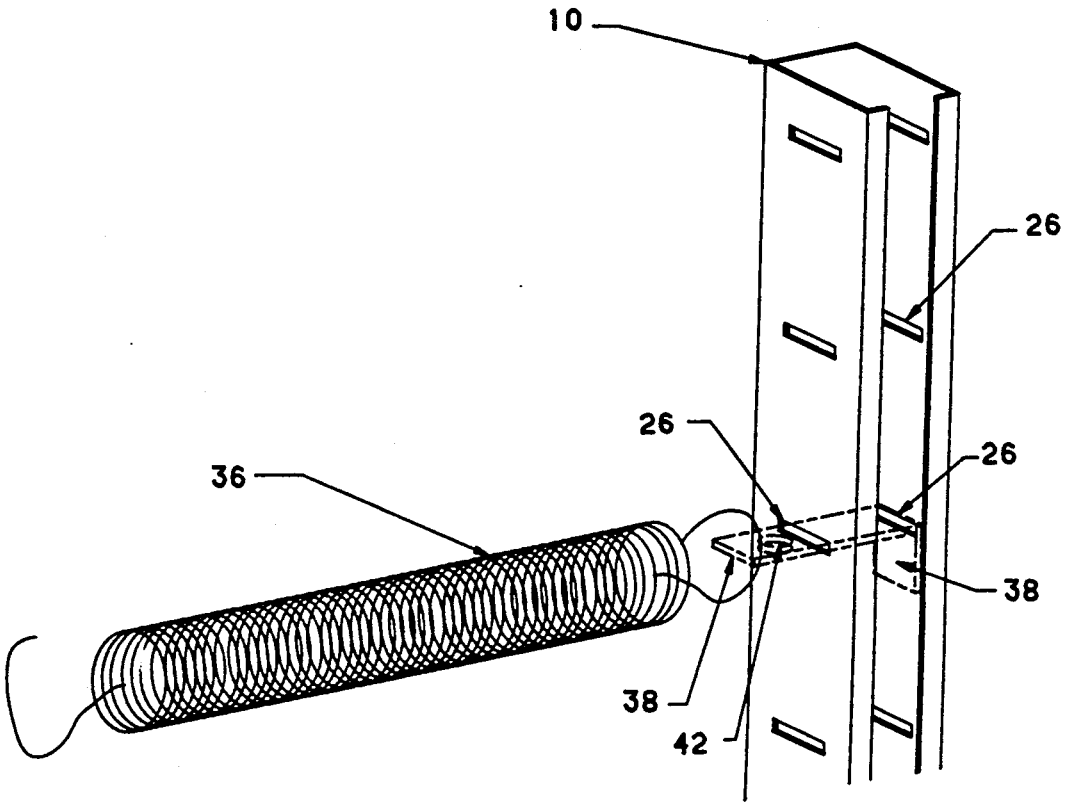
FIG. 5 is an enlarged, fragmentary perspective view showing details of the connection of one of the banner springs to a stanchion of FIG. 1.

Thus, bracket 46 can be placed at any desired position along stanchion 12 so that slot pairs 50 of bracket 46 register with slot pairs 26*b* of stanchion 12, slot pairs 26*b* being selected as desired from the array of slot pairs 26. Then, a cross bar 52, of design similar to the previous cross bars, may be thrust through the engaging slots 26*b*, 50 as shown in FIG. 4 to retain bracket 46, and light assembly 44, in a desired position on stanchion 12. Another locking rod 56 may then be provided to extend through apertures 58 of cross bars 52.

Thus, an adjustable support for banners is provided, which comprises at least a pair of vertically or longitudinally adjustable stanchions, to accommodate a variation of banner sizes and elevations. Additionally, at least some of the mountings of the banner to the stanchion may be resilient, to assist in the spilling of wind and to provide a deflection to the banner that will resist tearing of the banner due to excessive wind force.

The above has been offered for illustrative purposes only, and is not intended to limit the scope of the invention, which is as defined in the claims below.

That which is claimed is:

1. An adjustable support for banners, which comprises; at least a pair of stanchions of a certain length for connection to a banner, said stanchions each defining an array of transverse slots distributed along said length of each stanchion; at least a pair of spaced brackets attached to a support structure, each of said brackets defining a longitudinal aperture slidably receiving one of said stanchions in one of variable longitudinal positions, said brackets each also defining transverse slot means capable of registry with at least one transverse slot of the stanchion received in said longitudinal aperture; and first removable cross bar means extending through the transverse slot means of each bracket and said at least one transverse slot of the stanchion received in each bracket.

2. The adjustable support of claim 1 in which extension spring means may connect the banner to each stanchion.

3. The adjustable support of claim 2 in which second removable cross bar means extend through other of said transverse slots of each stanchion, said second cross bar means being connected to said spring means and serving to connect said spring means and banner to each stanchion.

4. The adjustable support of claim 1 in which second removable cross bar means extend through other of said transverse slots of each stanchion to connect a banner with said stanchions.

5. The adjustable support of claim 1 in which said brackets are capable of being attached to a building roof.

6. The adjustable support of claim 1 in which each stanchion defines at least three times as many of said transverse slots as there are slots of the transverse slot means in each bracket.

7. The adjustable support of claim 1 in which a light source is carried by said stanchions.

8. The adjustable support of claim 1 having means for releasably locking the cross bar means in a position extending through the transverse slot means.

9. An adjustable support for banners, which comprises: at least a pair of stanchions of a certain length for connection to a banner, said stanchions each defining an array of transverse slots distributed along said length of each stanchion; at least a pair of spaced brackets attached to a support structure, each of said brackets defining a longitudinal aperture slidably receiving one of said stanchions in one of variable longitudinal positions, said brackets also defining transverse slot means capable of registry with at least one transverse slot of the stanchion received in said longitudinal aperture; and first removable cross bar means extending through the transverse slot means of each bracket and said at least one transverse slot of the stanchion received in each bracket; a banner carried between said stanchions, extension spring means connected to said banner; second removable cross bar means extending through other of said transverse slots of each stanchion, said second cross bar means being connected to said spring means and serving to connect said spring means and banner to each stanchion; and means for releasably locking the first and second cross bar means in positions extending through the transverse slot means.

10. The adjustable support of claim 9 in which said extension spring means connect said banner to each stanchion at all corners thereof.

11. The adjustable support of claim 9 in which each stanchion defines at least three times as many of said transverse slots as there are slots of the transverse slot means in each bracket.

12. The adjustable support of claim 9 in which said brackets are capable of being attached to a building roof.

13. The adjustable support of claim 9 in which a light source is carried by said stanchions.

14. Means for adjustably supporting banners, which comprise: at least a pair of stanchions of a certain length for connection to a banner, and a banner positioned between said stanchions, the improvement comprising, in combination, extension spring means connecting said banner to at least one of said stanchions, said stanchions each defining an array of transverse slots distributed along the length thereof, and at least a pair of spaced brackets asscertable with a support structure, each of said brackets defining a longitudinal aperture slidably receiving one of said stanchions in one of variable longitudinal positions, said brackets also defining transverse slot means capable of registry with at least one transverse slot of the stanchion received in said longitudinal aperture; first removable cross bar means extending through the transverse slot means of each bracket and said at least one transverse slot of the stanchion received in each bracket; and second removable cross bar means extending through other of said transverse slots of each stanchion, said second cross bar means being connected to said spring means to connect said spring means and banner to said stanchion.

15. The adjustable support of claim 14 in which spring means connect said banner to said second cross bar means mounted in both stanchions.

16. The adjustable support of claim 15 in which each stanchion defines at least three times as many of said transverse slots as there are slots of the transverse slot means in each bracket.

17. The adjustable support of claim 16 having means for releasably locking the first and second cross bar means in a position extending through the transverse slot means.

18. The adjustable support of claim 15 in which a light source is carried by said stanchions.

* * * * *